US006093678A

United States Patent [19]

Hamada et al.

[11] Patent Number: 6,093,678

[45] Date of Patent: Jul. 25, 2000

[54] SPONTANEOUSLY COLOR CHANGING TYPE THERMAL SENSITIVE RECORDING MEDIUM

[75] Inventors: Kaoru Hamada; Tadakazu Fukuchi; Tomoaki Nagai; Reiko Sato, all of Tokyo; Yutaka Wakita, Ishinomaki, all of Japan

[73] Assignee: Nippon Paper Industries Co. Ltd., Tokyo, Japan

[21] Appl. No.: 09/135,644

[22] Filed: Aug. 18, 1998

[30] Foreign Application Priority Data

Aug. 19, 1997 [JP] Japan ..... 9-221832

[51] Int. Cl.[7] ..... B41M 5/30

[52] U.S. Cl. ..... 503/217; 427/150; 427/151; 503/216; 503/224

[58] Field of Search ..... 427/150–152; 503/216–220, 224

[56] References Cited

U.S. PATENT DOCUMENTS

| | | | |
|---|---|---|---|
| 3,895,173 | 7/1975 | Adachi | 428/537 |
| 4,431,706 | 2/1984 | Sato | 428/537 |
| 5,811,369 | 9/1998 | Nagai et al. | 503/209 |

FOREIGN PATENT DOCUMENTS

| | | | |
|---|---|---|---|
| 1531121 | 11/1978 | United Kingdom | 503/217 |

OTHER PUBLICATIONS

Abstract of Japanese Laid Open Patent Application Publication No.59–33183 (Feb. 22, 1984).

Abstract of Japanese Patent Publication No. 45–14039 (Jul. 19, 1970).

Abstract of Japanese Laid–Open Patent Appln. Pub. No. 2–258286 (Oct. 19, 1990).

Abstract of Japanese Laid–Open Patent Appln. Publ. No. 3–65383 (Mar. 20, 1991).

Abstract of Japanese Laid–Open Patent Appln. Pub. No. 52–140483 (Nov. 24, 1977).

*Primary Examiner*—Bruce H. Hess

[57] ABSTRACT

A thermal sensitive recording medium which has a feature to change the color of recorded pattern slowly and spontaneously after development, and the recorded pattern which has several days passed can be easily distinguished from that of just after development. Said thermal sensitive recording medium contains 4-hydroxybenzoic acid ester represented by general formula (I) as a color developer and uses triphenylmethane-based leuco dye and reddish color developing leuco dye whose maximum absorption wave length is 450~560 nm as a dye precursor.

(I)

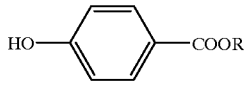

In this formula, R represents unsubstituted or substituted lower alkyl group of carbon number 1–7 or benzyl group.

8 Claims, No Drawings

SPONTANEOUSLY COLOR CHANGING TYPE THERMAL SENSITIVE RECORDING MEDIUM

BACKGROUND OF THE INVENTION

The present invention relates to a spontaneously color changing type thermal sensitive recording medium which utilizes a color developing reaction between electron donating color developing compound and electron accepting compound.

DESCRIPTION OF THE PRIOR ART

Generally, the thermal sensitive recording medium possessing a thermal sensitive recording layer mainly comprising a colorless or a pale colored electron donating dye precursor (hereinafter shortened to dye precursor) and a color developer which develops color when heated together with said dye precursor was disclosed in Japanese Patent publication 45-14039 and had been widely utilized practically. As a recording apparatus for this thermal sensitive recording media, a thermal printer to which a thermal head is installed can be used. The recording method mentioned above has strong points in comparison with other conventional recording methods, namely, noiseless during recording, a developing and a printing procedure are not needed, maintenance free, apparatus is relatively low price and compact and a recorded pattern is very vivid. Therefore, along with the growth of information industry, the application of this method is widely expanded, for instance, applications for a facsimile or a computer, for many kinds of measuring equipment and for a label. For these application, high concentrated recording density and features not to be faded out by time lapse, light, water or solvent are desired. That is, the inreversibility is required for recorded pattern. Therefore, the policy of research and development of this field has been restricted to above mentioned direction.

However, recently, along with the expansion and growth of the field which utilizes a thermal sensitive recording medium, a development of new thermal sensitive recording medium whose recorded pattern fades out or changes spontaneously and the recorded pattern of just after developed can be easily distinguish from that of after one day or two days lapse are required in the market such as an entrance ticket of amusement park or a lift boarding ticket of the skiing ground.

In the Japanese Patent Laid Open Publication 2-258286 and Japanese Patent Laid Open Publication 3-65383, a thermal sensitive recording medium whose recorded color pattern fades out after recorded which uses a color changeable pigment by oxidation-reduction state change is disclosed, further, in the Japanese Patent Laid Open Publication 52-140483, the medium which uses hidroxy benzoic esters is disclosed. However, since the recorded pattern of the media disclosed in above mentioned documents have a tendency to fade out within several hours or one day after developed, these media can not be used practically as a recording medium for information.

SUMMARY OF THE INVENTION

Thus, the object of this invention is to provide a spontaneously color changing type thermal sensitive recording medium, and the color of recorded pattern on said medium gradually changes and the pattern of just after developed can easily be distinguished from that of one day passed.

The above mentioned object can be accomplished by a spontaneously color changing type thermal sensitive recording medium having a thermal sensitive recording layer which contains a colorless or a pale color dye precursor and an organic color developer as the main components on a substrate, wherein said color developer is 4-hydroxybenzoic acid esters represented by general formula (I) and said dye precursor is a triphenylmethane-based leuco dye of and a reddish color developing leuco dye whose maximum absorption wave length is from 450–560 nm.

(I)

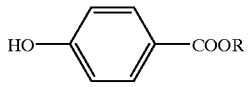

wherein, R represents unsubstituted or substituted lower alkyl group of carbon number 1–7 or benzyl group.

Generally, a thermal sensitive recording medium is composed by a dye precursor which is an electron donor and a color precursor which is an electron acceptor. Between said dye precursor and color developer, electrons are transferred by thermal fusion, and by the electron transferring a kind of complex is formed and a pattern is developed. When 4-hydroxybenzoic esters represented by general formula (I) is used as the color developer and triphenylmethane-based leuco dye and red color developing leuco dye whose maximum absorption wave length is from 450 to 560 nm are used as the dye precursor as disclosed in this invention, since the interaction between color developer and triphenylmethan-based leuco dye is small, the complex (blue color developing substance) formed by thermal fusion caused between said two compounds is gradually decomposed at the room temperature. Therefore, the color tone changes from blue to red.

The invention of claim 2 relates to the spontaneously color changing type thermal sensitive recording medium of claim 1, wherein the color difference b* value prescribed by Japanese Industrial Standard JIS-Z-8729 of the developed pattern just after development is smaller than 0 and the color difference b* value of the developed pattern of 24 hours after development increases by more than 10. The color difference b* value is a parameter which indicates the intensity of blue color. Bigger minus numerical value indicates deeper blue color and when minus numerical number is closed to zero the color becomes lighter blue. And when the value turns plus, the color turns yellowish or red color. In the present invention, the color difference b* value is used as an index, and the difference between b* value of pattern just after developed and that of after time lapse is regulated, which is an effective means to measure the degree (state) of color change. If the b* value increases by more than 10 compared to that of just after developed, the difference can be easily distinguished and it is sufficient to accomplish the object of this invention. Desirably, if the increase of b* is by more than 20, the thermal sensitive recording medium which have good discrimination can be obtained.

The invention of claim 3 relates to the thermal sensitive recording medium whose content of triphenylmethane-based leuco dye is 0.07 to 1 parts to 1 part of color developer and the content of reddish color developing leuco dye having maximum adsorption wave length at 450 to 560 nm is 0.05 to 1 part oftriphenylmethane-based leuco dye.

In general, in inventions referring to the thermal sensitive recording medium field, the main object of the invention is to improve a color sensitivity or to improve a preserving stability which prevents a fading out or a vanishing phenomena of a recorded pattern. The improvement of preserving stability of recorded pattern is contrary to the color spontaneously changing phenomenon which is the object of this invention, however, also in this invention, the recorded pattern is needed to have adequate color developing density which is sufficient for the actual use as the thermal sensitive recording medium. To obtain a spontaneously color changing type thermal sensitive recording medium which satisfies both color developing density and color changing tendency in good balance, it is effective in this invention to use 0.07 to 1 parts of triphenylmethane-based leuco dye to 1 part of 4-hydroxybenzoic esters which is a color developer and to use 0,05 to 1 parts of a red color developing leuco dye whose maximum absorption wave length is from 450 to 560 nm to 1 part of triphenylmethane-based leuco dye.

Further, in this invention, since it is necessary to distinguish the recorded pattern of several hours past from that of just after the development by naked eyes observation, the color tone change from blue to red is an important factor which effects to the degree of color change. By restricting the limitation of this invention in the region of claim 3, the thermal sensitive recording medium which vividly and distinguishably changes color of the recorded pattern is obtained.

When the content oftriphenylmethane-based leuco dye is bigger than 0.07 parts to 1 part of color developer, sufficient color developing sensitivity and adequate color changing speed of recorded pattern can be obtained and the color tone change is distinguishable. And when the content of triphenylmethane-based leuco dye is smaller than 1 part to 1 part of color developer, the color tone change of recorded pattern which has 24 or 48 hours past from the development is very clear when compared to the recorded pattern of just after developed. The color difference b* value becomes about 20 and the discrimination between recorded pattern which has several hours past from the development and recorded pattern of just after development is good.

When the content of triphenylmethane-based leuco dye is small, as shown in the results of Example 17, the color difference b* value of 20 minutes after development increases about 20 points and the color tone change is vivid, however, from the view point as an information recording media, the stability of recorded pattern is slightly bad and is suited to the application to distinguish a short term change of recorded pattern rather than a long term change for example several days. When the content of triphenylmethane-based leuco dye is large, as shown in the results of Example 16, the difference between color difference b* value of 24 or 48 hours after the development and that of just after development is bigger than 10, which is sufficient to be discriminated. However, in this case, since the color change is in same blue color tone, the degree of color change is not so obvious.

Meanwhile, when the content of reddish color developing leuco dye whose maximum absorption wave length is 450 to 560 nm is bigger than 0.05 parts to 1 part of triphenylmethane-based leuco dye, color tone change by time lapse is vivid, and when the content of reddish color developing leuco dye is smaller than 1 part to 1 part of triphenylmethane-based leuco dye, the initial color of developed pattern does not turn to red and the color change degree becomes intense.

For instance, as shown in the results of Example 19, when the content of reddish color developing leuco dye is small, the difference between color difference b* value of 24 hours past from the development and that of just after development is big and does not have a problem on a discrimination. However, in this case, since the color change is in same blue color tone, the degree of color change is not so intensive. And, on the contrary, as shown in the results of Example 18, when the content of reddish color developing leuco dye is large and the red color tone of initial developed pattern is too deep the difference between color difference b* value of 24 hours past from the development and that of just after development is bigger than 20, which is sufficient to be discriminated. However, in this case, since the color tone change is from royal purple to purplish red, the color tone change is slightly difficult to be discriminated.

Thus, in the present invention, by controlling the mixing ratio of content of triphenylmethane-based leuco dye which is used as a dye precursor and reddish color developing leuco dye whose maximum absorption wave length is from 450 to 560 nm, the thermal sensitive recording medium which can change a color changing speed or a color tone at need.

Further, the invention of claim 4 is a thermal sensitive recording medium comprising, 4-hydroxybenzoic-benzyl as a color developer and 3,3-bis(p-dimethylaminophenyl)-6-dimethylaminophtalide as a dye precursor.

DISCLOSURE OF THE INVENTION

A spontaneously color changing type thermal sensitive recording medium of this invention can be obtained by following procedure. That is, a thermal sensitive color developing coating is prepared by dispersing an organic color developer and a dye precursor together with a binder and add a filler and other additives at need and by coating and drying it on a substrate.

With respect to 4-hydroxybenzoic esters represented by general formula (I) of this invention, R of general formula (I) represents hydric carbon group and as the concrete examples an unsubstituted or a substituted alkyl group or a benzyl group can be mentioned. Further, it is possible to insert a substituted group which does not obstruct a color developing sensitivity or a color fading effect to R, and as the concrete example of the substituted group, lower alkyl groups such as methyl group or ethyl group can be mentioned. As the concrete examples of compound represented by general formula (I)

4-hydroxybenzoic acid methyl ester, 4-hydroxybenzoic acid ethyl ester, 4-hydroxybenzoic acid propyl ester, 4-hydroxybenzoic iso-propyl ester, 4-hydroxybenzoic acid buthyl ester, 4-hydroxybenzoic acid iso-buthyl ester, 4-hydroxybenzoic acid iso-amyl, 4-hydroxybenzoic acid hexyl ester, 4-hydroxybenzoic acid hepthyl ester, 4-hydroxybenzoic acid benzyl ester and 4-hydroxybenzoic acid methylbenzyl ester can be mentioned, however, is not intended to be limited to these compounds. Among these compounds mentioned above, from the view point of easily procurement and a good recording sensitivity, 4-hydroxybenzoicbenzyl can be preferably used. These 4-hydroxybenzoic esters can be used alone or by mixing.

In this invention, a color developer which prevents color changing property, for example, well known bis-phenol A can not be used.

As an example of triphenylmethane-based leuco dye used in this invention, 3,3-bis(p-dimethylaminophenyl)-6-dimethylaminophthalide, 3,3-bis(p-dimethylaminophenyl)-6-pyrrolydinophthalide, 3,3-bis(p-dimethylaminophenyl)phthalide, 3,3-bis(p-dimethylaminophenyl)-6-dimethylaminophthalide and 3,3-bis(p-dimethylaminophenyl)-6-di-n-propylaminophthalide can be mentioned, however, is not intended to be limited to these compounds. Among these compounds mentioned above, from the view point of easily procurement, and a good recording sensitivity and a good color changing property when used together with aforementioned 4-hydroxybenzoic acid benzyl ester, 3,3-bis(p-dimethylaminophenyl)-6-dimethylaminophthalide is preferably used.

These triphenylmethane-based leuco dyes can be used alone or by mixing more than two kinds of them.

As a reddish color developing leuco dye used in this invention, the leuco dye whose maximum absorption wave length measured in 99% acetic acid solution is 450~560 nm can be used. As the concrete example, 3-diethylamino-6-methyl-7-chlorofluorane (λ max: 499, 531 nm), 3-cyclohexylamino-6-chlorofluorane (λ max: 475 nm), 3-diethylamino-benzo(a)fluorane (λ max: 520 nm), 3-diethylamino-7-chlorofluorane (λ max: 500, 532 nm), 3-diethylamino-7-methylfluorane (λ max: 493, 525 nm), 3-N-ethyl-N-isoamylamino-benzo(a)fluorane (λ max: 523 nm)

3-N-ethyl-N-p-metylphenylamino-7-methylfluorane (λ max: 518 nm), 3-diethylamino-6,8-dimethylfluorane (λ max: 495, 525 nm), 3-dibuthylamino-6-methyl-7-buromofluorane (λ max: 501, 537 nm), 3,6-bis(diethylamino)fluorane-γ-(4'-nitro)-anilinolactam(λ max: 560 nm), 3,3-bis(1-n-butyl-2-methylindol-3-yl)phthalide(λ max: 536 nm), 3,3-bis(1-ethyl-2-methylindol-3-yl)phthalide(λ max: 535 nm) and 3,6-bis(diethylamino)fluorane-γ-anilinolactam(λ max: 557 nm)

can be mentioned, however is not intended to be limited to them. The numerical value of λ max indicated in parentheses is a maximum absorption wave length in 99% acetic acid solution. These red color developing leuco dyes can be used alone or by mixing more than two kinds of them to obtain an aimed reddish color such as red, magenta, vermilion, orange or purplish red.

In this invention, a conventional well known sensitizer can be used in the limitation in which the desired effect of this invention is not prevented. As an example of the sensitizer, stearic acid amide, palmitic acid amide, methoxycarbonyl-N-benzamidestearate, N-benzoylstearic acid amide, N-eicosenoic acid amide, ethylene-bis-stearic acid amide, behenic acid amide, methylene-bis-stearic acid amide, methylolamide, N-methylolstearic acid amide, dibenzyl terephthalate, dimethyl terephthalate, dioctyl terephthalate, p-benzyloxybenzylbenzoate, 1-hydroxy-2-phenylnaphthoate, dibenzyloxalate, di-p-methylbenzyloxalate, di-p-chlorobenzyloxalate, 2-naphthylbenzylether, m-tarphenyl, p-benzylbiphenyl, 4-biphenyl-p-tolylether, di(p-methoxyphenoxyethyl)ether, 1,2-di(3-methylphenoxy)ethane, 1,2-di(4-methylphenoxy)ethane, 1,2-di(4-methoxylphenoxy)ethane, 1,2-di(4-chlorophenoxy)ethane, 1,2diphenoxyethane, 1-(4-methoxyphenoxy)-2-(2-methylphenoxy)ethane, p-methyltiophenylbenzylether, 1,4-di(phenyltio)buthane, p-acetotoluidide, p-cetophenetidide, N-acetoacetyl-p-toluidine, di-(β-biphenylethoxy)benzene, p-di(vinyloxyethoxy)benzene, 1-isopropylphenyl-2-phenylethane 1,2-bis(phenoxymethyl)benzene p-toluenesulfonamide, o-toluenesulfonamide, di-p-tolylcarbonate and phenyl-α-naphtylcarbonate can be mentioned, however is not intended to be limited to these compounds. These sensitizers can be used alone or by mixing more than two kinds of them.

As a binder to be used in this invention, full saponificated polyvinyl alcohol of 200~1900 degree of polymerization, partially saponificated polyvinyl alcohol, denatured polyvinyl alcohol such as ; denatured polyvinyl alcohol by carboxyl, denatured polyvinyl alcohol by amide, denatured polyvinyl alcohol by sulfonic acid and denatured polyvinyl alcohol by butylal, cellulose derivatives such as ; hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetal, polyacrylicamide, polyacrylic acid ester, polyvinylbutylal, polystyrene and copolymer ofthese polymer, polyamide resin, silicon resin, petroleum resin, terpene resin, ketone resin and cumarone resin can be mentioned as an example. These high molecular compound can be used not only by dissolving into solvent e.g. water, alcohol, ketone, ester or hydrocarbon but also in paste state by dispersing or emulsifying in water or other medium and these states can be preferred or used by combination according to the aimed quality.

As a filler which can be used in this invention, an inorganic or an organic filler such as silica, calcium carbonate, kaoline, calcined kaoline, diatomaceous earth, talc, titanium oxide, zinc oxide, aluminum hydroxide, polystyrene resin, urea-formalin resin, copolymer of styrenemethacrylilate acid, copolymer of styrene-butadiene and hollow plastic pigment can be mentioned.

Further, a parting agent such as metallic salt of fatty acid, a slipping agent such as wax, an ultra violet ray absorbent such as benzophenone-based or triazole-based, a water proof agent such as glyoxal, a dispersing agent, a deformer, an anti-oxidation agent and a fluorescent dye can be used as an additive.

As a substrate, paper, synthetic paper, plastic film, non-woven cloth, metallic foil and a hybrid sheet composed by said substances can be used.

Further, for the purpose to improve a friction resistance, an overcoat layer composed by macromolecule substance composition can be prepared on the surface of thermal sensitive color developing layer. Furthermore, for the purpose to improve the color sensitivity, an undercoat layer containing organic or inorganic filler can be prepared between color developing layer and substrate.

The amount of color developer and dye precursor, the kind and amount of other additives to be used to the spontaneously color changing type thermal sensitive recording medium of this invention are decided according to the required quality and recording feature, and not restricted. However, in general, it is preferable to use 0.5~4 parts of filler to 1 part of color developer and 5~25% of binder to the total amount of solid. And also, it is preferable to use 0.07~1 parts of triphenylmethane-based leuco dye to 1 part of color developer and this amount can be adjusted along with the desired recording sensitivity, color changing speed and color tone. Further, the desirable amount of a reddish color developing leuco dye whose maximum absorption wave length is 450~560 nm is 0.05~1 parts to 1 part of triphenylmethane-based leuco dye, and also this amount can be adjusted along with the desired recording sensitivity, color changing speed and color tone.

These color developer, dye and other additives which are added at need are ground to the fine particles smaller than several microns diameter by means of a pulverizer such as a ball mill, an attritor or a sand grinder, or by means of an adequate emulsifying device, then binder and other additives are added at need, thus the coating is prepared. As a method to coat the coating, a hand coating, a size press coating method, a roll coating method, an air knife coating method, a blend coating method, a flow coating method, a comma direct method, a gravure direct method, a gravure reverse method and a reverse roll coating method can be mentioned. Further, the method to dry up after sputtering, spraying or dipping can also be used.

EXAMPLES AND COMPARATIVE EXAMPLES

Preparation of spontaneously color changing type thermal sensitive recording medium The spontaneously color changing type thermal sensitive recording medium of this invention is illustrated by following Examples. In Examples, terms of parts and % indicate parts by weight and weight %.

Example 1

Example 1 is an example of the spontaneously color changing type thermal sensitive recording medium of this invention in which 4-hydroxybenzoic acid benzyl ester (hereinafter shortened to BZ) is used as a color developer, 3,3-bis(p-dimethylaminophenyl)-6-dimethylaminophthalide (shortened to CVL) is used as a triphenylmethane-based leuco dye and 3,3-bis(1-n-buthyl-2-methylindol-3-yl) phthalide (shortened to Red 40) is used as a reddish color developing dye whose maximum absorption wave length is 450~560 nm.

Dispersion of color developer (A solution), dispersion of triphenylmethane-based leuco dye (B solution) and reddish leuco dye (C solution) prepared by following blending proportion are separately ground in a wet condition to average diameter of 1 $\mu$m by means of a sand grinder.

| | |
|---|---|
| A solution (dispersion of color developer) | |
| 4-hydroxybenzoic acid benzyl ester (BZ) | 6.0 parts |
| 10% aqueous solution of polyvinylalcohol | 18.8 parts |
| water | 11.2 parts |
| B solution (dispersion of triphenylmethane-based leuco dye) | |
| 3,3-bis(p-dimethylaminophenyl)-6-dimethylaminophthalide (CVL) | 1.0 parts |
| 10% aqueous solution of polyvinylalcohol | 2.3 parts |
| water | 1.3 parts |
| C solution (dispersion of reddish leuco dye) | |
| 3,3-bis(1-n-buthyl-2-methylindol-3-yl)phthalide (Red 40) | 1.0 parts |
| 10% aqueous solution of polyvinylalcohol | 2.3 parts |
| water | 1.3 parts |

Then the resulting dispersion are mixed together by the proportion below and the coating is prepared.

| | |
|---|---|
| A solution (dispersion of color developer [BZ]) | 36.0 parts |
| B solution (dispersion of triphenylmethane-based leuco dye [CVL]) | 13.8 parts |
| C solution (dispersion of reddish leuco dye [Red 40]) | 4.6 parts |
| Kaoline clay (50% dispersion) | 12.0 parts |

The prepared coating is applied to one side of 50 g/m$^2$ substrate paper and dried up, then the paper is processed by a super calendar to surface smoothness of 500–600 second and the spontaneously color changing type thermal sensitive recording medium of 6.0 g/m$^2$ coating amount can be obtained.

Example 2

The spontaneously color changing type thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 13.8 parts |
| C solution (dispersion of reddish leuco dye [Red 40]) | 2.3 parts |
| Kaoline clay (50% dispersion) | 12.0 parts |

Example 3

The thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 13.8 parts |
| C solution (dispersion of reddish leuco dye [Red 40]) | 1.38 parts |
| Kaoline clay (50% dispersion) | 12.0 parts |

Example 4

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 18.4 parts |
| C solution (dispersion of reddish leuco dye [Red 40]) | 1.38 parts |
| Kaoline clay (50% dispersion) | 12.0 parts |

Example 5

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 23.0 parts |
| C solution (dispersion of reddish leuco dye [Red 40]) | 1.38 parts |
| Kaoline clay (50% dispersion) | 12.0 parts |

Example 6

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 2.3 parts |
| C solution (dispersion of reddish leuco dye [Red 40]) | 0.23 parts |
| Kaoline clay (50% dispersion) | 12.0 parts |

Example 7~8

The spontaneously color changing type thermal sensitive recording medium is prepared by the same procedure to Example 1. At the preparation of A solution, 4-hydroxybenzoic acid ethyl ester (shortened to Et) and 4-hydroxybenzoic acid methyl ester (shortened to Me) are used instead of 4-hydroxybenzoic acid benzyl ester (BZ)

Example 9

The spontaneously color changing type thermal sensitive recording medium is prepared by the same procedure to Example 1. In this Example, 4-hydroxybenzoic acid benzyl ester (BZ) and 4-hydroxybenzoic acid methyl ester (Me) are used together with as the color developer. The mixing proportion of dispersion is mentioned below.

| | |
|---|---|
| A solution (dispersion of color developer [BZ]) | 18.0 parts |
| A solution (dispersion of color developer [Me]) | 18.0 parts |
| B solution (dispersion of triphenylmethane-based leuco dye [CVL]) | 13.8 parts |
| C solution (dispersion of reddish leuco dye [Red 40]) | 4.6 parts |
| Kaoline clay (50% dispersion) | 12.0 parts |

Example 10~11

The spontaneously color changing type thermal sensitive recording medium is prepared by the same procedure to Example 1. At the preparation of B solution, 3,3-bis(p-dimethylaminophenyl)-6-pyrrolydinophthalide and 3,3-bis (p-dimethylaminophenyl)phthalide are used instead of CVL.

Example 12

The spontaneously color changing type thermal sensitive recording medium is prepared by the same procedure to Example 1. In this Example, CVL and 3,3-bis(p-dimethylaminophenyl)phthalide are used together with as triphenylmethane-based leuco dye. The mixing proportion of dispersion is mentioned below.

| | |
|---|---|
| A solution (dispersion of color developer [BZ]) | 36.0 parts |
| B solution (dispersion of dye precursor [CVL]) | 6.9 parts |
| B solution (dispersion of dye precursor [3,3-bis(p-dimethylamino-phenyl)phthalide]) | 6.9 parts |
| C solution (dispersion of reddish leuco dye [Red 40] | 4.6 parts |

Example 13~14

The spontaneously color changing type thermal sensitive recording medium is prepared by the same procedure to Example 1. At the preparation of C solution, 3-cyclohexylamino-6-chlorofluoran (shortened to Orange 100) and 3,3-bis(1ethyl-methylindol-3-yl)phthalide (shortened to Indolyl Red) are used in stead of Red 40.

Example 15

The spontaneously color changing type thermal sensitive recording medium is prepared by the same procedure to Example 1. In this Example, Red40 and Orange 100 are used together with as the reddish leuco dye. The mixing proportion of dispersion is mentioned below.

| | |
|---|---|
| A solution (dispersion of color developer [BZ]) | 36.0 parts |
| B solution (dispersion of dye precursor [CVL]) | 13.8 parts |
| C solution (dispersion of reddish leuco dye [Red 40]) | 2.3 parts |
| C solution (dispersion of reddish leuco dye [Indolyl Red]) | 2.3 parts |
| Kaoline clay (50% dispersion) | 12.0 parts |

Example 16

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 32.2 parts |
| C solution (dispersion of reddish leuco dye [Red 40]) | 4.6 parts |
| Kaoline clay (50% dispersion) | 12.0 parts |

Example 17

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 1.38 parts |
| C solution (dispersion of reddish leuco dye [Red 40]) | 0.69 parts |
| Kaoline clay (50% dispersion) | 12.0 parts |

Example 18

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 13.8 parts |
| C solution (dispersion of reddish leuco dye [Red 40]) | 16.56 parts |
| Kaoline clay (50% dispersion) | 12.0 parts |

Example 19

The spontaneously color changing thermal sensitive recording medium is prepared by the same procedure to Example 1. The mixing proportion of dispersion is mentioned below.

| | |
|---|---|
| A solution (dispersion of color developer [BZ]) | 36.0 parts |
| B solution (dispersion of triphenylmethane-based leuco dye [CVL]) | 13.8 parts |
| C solution (dispersion of reddish leuco dye [Red 40]) | 0.138 parts |
| Kaoline clay (50% dispersion) | 12.0 parts |

Comparative Example 1

Comparative Example 1 is an example to use bis-phenol A (BPA) as a color developer. The thermal sensitive recording medium for Comparative Example is prepared by the same procedure to Example 1. Dispersion of BPA (D solution) is ground in a wet condition to average diameter of 1 $\mu$m by means of a sand grinder.

| D solution (dispersion of color developer [BPA]) | |
|---|---|
| bisphenol A (BPA) | 6.0 parts |
| 10% polyvinylalchol aqueous solution | 18.8 parts |
| water | 11.2 parts |

Then the resulting dispersion are mixed together by the proportion below and the coating is prepared (0.17 parts of dye to 1 part of color developer).

| | |
|---|---|
| D solution (dispersion of color developer [BPA]) | 36.0 parts |
| B solution (dispersion of triphenylmethane-based leuco dye [CVL]) | 13.8 parts |
| C solution (dispersion of reddish leuco dye [Red 40]) | 4.6 parts |
| Kaoline clay (50% dispersion) | 12.0 parts |

Comparative Example 2

Comparative Example 2 is a example to use 3-(4diethylamino-2ethoxyphenyl)-3-(1-ethyl-2-methylindol-3-yl)-4-azaphthalide (shortened to Blue 63) instead of triphenylmethane-based leuco dye. The thermal sensitive recording medium for Comparative Example is prepared by the same procedure to Example 1. Dispersion of Blue 63 (E solution) is ground in a wet condition to average diameter of 1 $\mu$m by means of a sand grinder.

| E solution (dispersion of dye precursor) | |
|---|---|
| Blue 63 | 1.0 parts |
| 10% polyvinylalchol aqueous solution | 2.3 parts |
| water | 1.3 parts |

Then the resulting dispersion are mixed together by the proportion below and the coating is prepared (0.17 parts of dye to 1 part of color developer).

| | |
|---|---|
| D solution (dispersion of color developer [BZ]) | 36.0 parts |
| E solution (dispersion of dye precursor [Blue 63]) | 4.6 parts |
| C solution (dispersion of reddish leuco dye [Red 40]) | 4.6 parts |
| Kaoline clay (50% dispersion) | 12.0 parts |

Method for evaluation

Using a thermal sensitive printer (product of MARK-POINT Co., Ltd.) in which a thermal head KM2004-A3 (product of ROMH Co., Ltd.) is installed, recording tests are carried out on prepared spontaneously color changing type thermal sensitive recording medium by 0.137 mj/dot impressive energy. The color difference b* value prescript in JIS-Z-8729 is measured by spectro color difference meter (NF-999; product of Nippon Denshoku Kogyo Co., Ltd.), and this value is established as an initial color difference b* value. The specimen on which a pattern is recorded are left for 20 minutes, 24 hours and 48 hours in the room kept at 20° C. and 60% RH, then the color difference b* value of recorded position is measured, thus the degree of color changing is evaluated. Further the appearance evaluation test by naked eyes of the operator is carried out. In the appearance evaluation test, mark A indicates that the specimen which has passed 24 hours from the development can easily be distinguished from that of just after development, mark B indicates that the specimen which has passed 48 hours from development can be distinguished from that of just after development and others are ranked as mark C. The obtained results are summarized in Table 1 and Table 2.

TABLE 1

A list of color developer and dye precursor

| Test number | color developer | Leuco dye: triphenyl methane *4 | Leuco dye: Reddish *5 | color density: just after developed |
|---|---|---|---|---|
| Example 1 | BZ | CVL(0.5) | Red 40(0.33) | 1.35 |
| Example 2 | BZ | CVL(0.5) | Red 40(0.17) | 1.43 |
| Example 3 | BZ | CVL(0.5) | Red 40(0.1) | 1.41 |
| Example 4 | BZ | CVL(0.67) | Red 40(0.075) | 1.42 |
| Example 5 | BZ | CVL(0.83) | Red 40(0.06) | 1.39 |
| Example 6 | BZ | CVL(0.083) | Red 40(0.1) | 1.25 |
| Example 7 | Et | CVL(0.5) | Red 40(0.33) | 1.27 |
| Example 8 | Me | CVL(0.5) | Red 40(0.33) | 1.26 |
| Example 9 | BZ/Me | CVL(0.5) | Red 40(0.33) | 1.32 |
| Example 10 | BZ | *1(0.5) | Red 40(0.33) | 1.20 |
| Example 11 | BZ | *2(0.5) | Red 40(0.33) | 1.18 |
| Example 12 | BZ | *3(0.5) | Red 40(0.33) | 1.29 |
| Example 13 | BZ | CVL(0.5) | Orange100(0.33) | 1.39 |
| Example 14 | BZ | CVL(0.5) | Indolyl Red(0.33) | 1.34 |
| Example 15 | BZ | CVL(0.5) | Red 40/Indolyl Red(0.33) | 1.35 |
| Example 16 | BZ | CVL(1.17) | Red 40(0.14) | 1.40 |
| Example 17 | BZ | CVL(0.05) | Red 40(0.5) | 1.18 |
| Example 18 | BZ | CVL(0.5) | Red 40(1.2) | 1.43 |
| Example 19 | BZ | CVL(0.5) | Red 40(0.01) | 1.41 |
| Com.Ex.1 | BPA | CVL(0.5) | Red 40(1) | 1.42 |
| Com.Ex.2 | BZ | Blue63(0.17) | Red 40(1) | 1.47 |

(Remarks)
*1: 3,3-bis(p-dimethylaminophenyl)-6-pyrrolydinophthalide
*2: 3,3-bis(p-dimethylaminophenyl)phthalide
*3: CVL/3,3-bis(p-dimethylaminophenyl)phthalide
*4: numerical number in parenthesis indicates parts of triphenylmethane-based leuco dye to one part of color developer
*5: numerical number in parenthesis indicates parts of reddish color developing leuco dye to 1 part of triphenylmethane-based leuco dye

TABLE 2

Change of color difference b* and color tone after developed

| Test Number | after printed | 20 minutes after | 24 hours after | 48 hours after | evaluation by naked eye |
|---|---|---|---|---|---|
| Example 1 | −54.9(B) | −54.9(B) | −5.2(PR) | 2.7(R) | A |
| Example 2 | −54.3(B) | −54.3(B) | −9.1(PR) | 4.2(R) | A |
| Example 3 | −60.7(B) | −60.7(B) | −20.7(RP) | −1.3(PR) | A |
| Example 4 | −60.8(B) | −60.8(B) | −18.7(RP) | −1.6(PR) | A |
| Example 5 | −62.7(B) | −62.7(B) | −24.5(PR) | −3.9(RP) | A |
| Example 6 | −38.9(B) | −36.6(B) | 2.3(R) | 4.1(R) | A |
| Example 7 | −40.5(B) | −38.6(B) | 2.8(R) | 4.7(R) | A |
| Example 8 | −43.7(B) | −41.7(B) | 2.5(R) | 4.6(R) | A |
| Example 9 | −45.9(B) | −45.3(B) | −1.6(PR) | 5.0(R) | A |
| Example 10 | −46.3(B) | −45.3(B) | 2.3(R) | 4.4(R) | A |
| Example 11 | −44.5(B) | −43.6(B) | 2.8(R) | 4.9(R) | A |
| Example 12 | −45.9(B) | −45.6(B) | −0.5(R) | 5.0(R) | A |
| Example 13 | −22.9(DB) | −22.9(DB) | 32.0(OR) | 42.3(OR) | A |
| Example 14 | −48.6(B) | −48.6(B) | −4.4(PR) | 4.6(R) | A |
| Example 15 | −50.7(B) | −50.7(B) | −6.1(PR) | 3.7(R) | A |
| Example 16 | −65.6(B) | −65.2(B) | −49.6(B) | −38.7(B) | B |
| Example 17 | −38.2(B) | −18.7(RP) | 2.8(R) | 5.1(R) | A |
| Example 18 | −20.8(RP) | −20.8(RP) | −1.4(PR) | 6.9(R) | B |
| Example 19 | −61.4(B) | −61.4(B) | −25.8(B) | −3.9(RP) | B |
| Com.Ex. 1 | −51.8(B) | −51.8(B) | −51.8(B) | −51.8(B) | C |
| Com.Ex. 2 | −52.8(B) | −52.8(B) | −52.8(B) | −52.8(B) | C |

(Remarks): Mark in parenthesis indicates color tone by appearance evaluation as follows, (B): blue, (R): red, (PR): purplish red, (RP): royal purple, (DB): dark blue, (OR): orange Evaluation results As obviously understood from the results of Table. 1 and Table.2, the Examples 1~19 of this invention are the substantial examples which use 4-hydroxybenzoic acid esters represented by general formula (I), triphenylmethane-based leuco dye and reddish color developing leuco dye whose maximum absorption wave length is 450~560 nm, and the degree of color change of 24 hours passed to that of just after development superiors to that of the Comparative Examples which do not use 4-hydroxybenzoic acid esters or triphenylmethane-based leuco dye.

Further, in the Examples 1~15 which contain 0.07~1 parts of triphenylmethane-based leuco dye to 1 part of color developer and 0.05~1 parts of reddish color developing leuco dye to 1 part of triphenylmethane-based leuco dye, there is not so big difference in the color difference b* value between that of just after development and that of 20 minutes passed and the stability of recorded pattern is good. And, the difference between color difference b* value of 24 after development and that of just after development is bigger than 20, further the color tone change is distinguishable by appearance. Therefore, the thermal sensitive recording medium of this invention is suited for the application which is necessary to distinguish the recorded pattern which is just after development from that of one or two days passed.

In the Example 17 which contains 0.05 parts of triphenylmethane-based leuco dye to 1 part of color developer, the color difference b* value of 20 minutes passed after development increases about 20 points and the color tone change by appearance is visible, however, the stability of image is slightly bad and is suited to the application to distinguish short term change of recorded pattern rather than long term change such as after several days. In the Example 16 which contain 1.17 parts of triphenylmethane-based leuco dye to 1 part of color developer, although the color change is in same blue color tone and the degree of color change is not so obvious, the difference between color difference b* value of 24 or 48 hours passed from development and that of just after development is bigger than 10 and is sufficient for the practical use.

Example 19 which contains 0.01 parts of reddish color developing leuco dye to 1 part of triphenylmethane-based leuco dye, the color tone change by appearance is slightly difficult to distinguish, however, the difference between color difference b* value of 24 hours passed after development and that of just after development is bigger than 20 and has a sufficient discrimination. And, Example 18 which contains 1.2 parts of reddish color developing leuco dye to 1 part of triphenylmethane-based leuco dye, since the color of just after development is reddish, the color tone change is slightly difficult to distinguish by appearance evaluation, however, the difference between color difference b* value of 24 hours passed after development and that of just after development is bigger than 20, it is sufficient for discrimination.

The thermal sensitive recording medium of this invention, even if the color tone change is not so vivid, since the color change progresses by time lapse, it can be used for the application which is necessary to be distinguished after long term lapse. The thermal sensitive recording medium of Examples 16, 18 and 19 are the thermal sensitive recording medium which are suited for the purpose to distinguish the recorded pattern of long term passed from that of just after developed lather than one or two days passed.

EFFECT OF THE INVENTION

The spontaneously color changing type thermal sensitive recording medium of this invention has a sufficient color developing sensitivity and the color fades out slowly, therefore the recorded pattern of one or two days passed can easily distinguished from that of just after printed. Therefore, the thermal sensitive recording medium of this invention fulfils it's function as the recording medium same as the conventional thermal sensitive recording medium for several hours after development, and after one or two days the color obviously changes and has a remarkable distinguishing feature. The thermal sensitive recording medium of this invention can be applied to the use which prevent the reuse of an used ticket such as a lift riding ticket of a skiing ground or as entrance ticket of an amusement park, further the use which is necessary to distinguish from that issued on the previous day such as a statement of delivery.

What is claimed is:

1. A spontaneously color changing type thermal sensitive recording medium having a thermal sensitive recording layer which contains a colorless or a pale color dye precursor and an organic color developer as the main components on a substrate, wherein said color developer is 4-hydroxybenzoic esters represented by general formula (I):

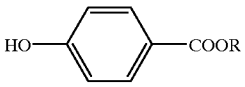

(I)

wherein, R represents unsubstituted or substituted lower alkyl group of carbon number 1–7 or benzyl group, and said dye precursor is a leuco dye of triphenylmethane and a reddish color developing leuco dye whose maximum absorption wave length is from 450 to 560 nm.

2. The spontaneously color changing type thermal sensitive recording medium of claim 1, wherein the color difference b* value prescribed by Japanese Industrial Standard-Z-8729 of the developed pattern just after development is smaller than 0 and the color difference b* value of the developed pattern of 24 hours after development is bigger than that of just after development by 10.

3. The spontaneously color changing type thermal sensitive recording medium of claim 1 or 2, wherein the content of triphenylmethane-based leuco dye is 0.07 to 1 parts to 1 part of color developer and the content of reddish color developing leuco dye whose maximum absorption wave length is from 450 to 560 nm is 0.05 to 1 parts to 1 part of triphenylmethane-based leuco dye.

4. The spontaneously color changing type thermal sensitive recording medium of claim 3, wherein 4-hydroxybenzoic acid ester is 4-hydroxybenzoic acid benzyl ester and triphenylmethane-based leuco dye is 3,3-bis (p-dimethylaminophenyl)-6-dimethylamino-phthalide.

5. The spontaneously color changing type thermal sensitive recording medium of claim 1 or 2, wherein 4-hydroxybenzoic acid ester is 4-hydroxybenzoic acid benzyl ester and triphenylmethane-based leuco dye is 3,3-bis (p-dimethylamino-phenyl)-6-dimethylaminophthalide.

6. A spontaneously color changing type thermal sensitive recording medium having a thermal sensitive recording layer which contains a colorless or a pale color dye precursor and an organic color developer as the main components on a substrate, wherein said color developer is 4-hydroxybenzoic esters represented by general formula (I):

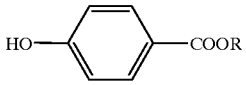

(I)

wherein, R represents unsubstituted or substituted lower alkyl group of carbon number 1–7 or benzyl group, and said dye precursor is a leuco dye of triphenylmethane and a reddish color developing leuco dye whose maximum absorption wave length is from 450 to 560 nm, wherein the content of triphenylmethane-based leuco dye is 0.07 to 1 parts to 1 part of color developer and the content of reddish color developing leuco dye whose maximum absorption wave length is from 450 to 560 nm is 0.05 to 1 parts to 1 part of triphenylmethane-based leuco dye.

7. A spontaneously color changing type thermal sensitive recording medium having a thermal sensitive recording layer which contains a colorless or a pale color dye precursor and an organic color developer as the main components on a substrate, wherein said color developer is 4-hydroxybenzoic esters represented by general formula (I):

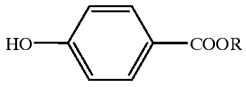

(I)

wherein, R represents unsubstituted or substituted lower alkyl group of carbon number 1–7 or benzyl group, and said dye precursor is a leuco dye of triphenylmethane and a reddish color developing leuco dye whose maximum absorption wave length is from 450 to 560 nm, wherein the color different b* value prescribed by Japanese Industrial Standard-Z-8729 of the developed pattern just after development is smaller than 0 and the color different b* value of the developed pattern of 24 hours after development is bigger than that of just after development by 10, and wherein the content of triphenylmethane-based leuco dye is 0.07 to 1 parts to 1 part of color developer and the content of reddish color developing leuco dye whose maximum absorption wave length is from 450 to 560 nm is 0.05 to 1 parts to 1 part of triphenylmethane-based leuco dye.

8. The spontaneously color changing type thermal sensitive recording medium of claim 6 or 7, wherein 4-hydroxybenzoic acid ester is 4-hydroxybenzoic acid benzyl ester and triphenylmethane-based leuco dye is 3,3-bis (p-dimethylaminophenyl)-6-dimethylamino-phthalide.

* * * * *